US006129078A

United States Patent [19]

Moulder

[11] Patent Number: 6,129,078

[45] Date of Patent: Oct. 10, 2000

[54] MOUNTING APPARATUS FOR PORTABLE STOVES

[76] Inventor: Charles R. Moulder, 300 E. 40th St., Apt. 10-E, New York, N.Y. 10116

[21] Appl. No.: 09/319,235

[22] PCT Filed: Dec. 10, 1997

[86] PCT No.: PCT/US97/23178

§ 371 Date: Jun. 4, 1999

§ 102(e) Date: Jun. 4, 1999

[87] PCT Pub. No.: WO98/26218

PCT Pub. Date: Jun. 18, 1998

Related U.S. Application Data

[63] Continuation-in-part of application No. 08/763,185, Dec. 10, 1996, Pat. No. 5,983,883.

[51] Int. Cl.[7] ..... F24C 3/08

[52] U.S. Cl. ..... 126/40; 126/38; 126/50; 126/9 R; 126/24; 248/311.3

[58] Field of Search ..... 126/38, 40, 9 R, 126/24, 36, 37 R, 39 B, 42, 44, 50, 52; 248/311.3; 269/131; 294/149, 150, 151, 157

[56] References Cited

U.S. PATENT DOCUMENTS

| | | | |
|---|---|---|---|
| 3,900,281 | 8/1975 | Penberthy | 431/344 |
| 4,005,844 | 2/1977 | Richmond | 248/311.3 |
| 4,577,418 | 3/1986 | Nagy | 36/72 B |
| 4,796,936 | 1/1989 | Nagy | 294/31.2 |
| 4,809,671 | 3/1989 | Vallejo, Jr. | 126/39 R |
| 4,832,398 | 5/1989 | Tecca et al. | 294/151 |
| 4,954,075 | 9/1990 | Francino | 431/107 |
| 5,211,157 | 5/1993 | Schwartz et al. | 126/39 E |
| 5,307,798 | 5/1994 | Overmars, Sr. | 126/40 |
| 5,323,757 | 6/1994 | Humphrey | 126/24 |
| 5,370,527 | 12/1994 | Hefling et al. | 431/247 |
| 5,425,354 | 6/1995 | Park | 126/50 |
| 5,431,146 | 7/1995 | Humphrey | 126/24 |
| 5,782,449 | 7/1998 | Church et al. | 248/346.3 |

*Primary Examiner*—Larry Jones
*Attorney, Agent, or Firm*—Cantor Colburn, LLP

[57] ABSTRACT

A supporting device used to securely mount a selectively removable portable stove and a fuel tank to a planar supporting structure without the use of hand tools. A base which includes an upper surface, lower surface, stove receiving region and tank receiving region has positioned above the stove receiving region a stove mounting plate. The stove mounting plate is positioned a fixed distance above the upper surface of the base. The spacing insulates the base from the heat of the stove.

27 Claims, 6 Drawing Sheets

MOUNTING APPARATUS FOR PORTABLE STOVES

This application is a continuation-in-part of U.S. application Ser. No. 08/763,185 filed Dec. 10, 1996, now U.S. Pat. No. 5,983,883, the entire disclosure of which is hereby incorporated by reference.

BACKGROUND OF THE INVENTION

A. Field of the Invention

The present invention generally relates to supports, and more particularly, to a supporting system for providing a safe and secure working surface for use with camping-type portable stoves, and their fuel supply.

B. Discussion of the Related Art

Portable stoves of the type typically used during camping are specifically designed to be compact and lightweight. Although the portable stoves are small and light enough to be easily packed and carried in a backpack, the stoves are inherently instable when assembled and in use at a campsite. These stoves operate on butane, propane or white gas which is contained in a separate tank or bottle and is also carried by the camper.

Owing to their light weight and compact design, a common problem with these portable stoves is that they require a substantially flat and heat-insulative operating surface. In an outdoor environment which these stoves are typically used, such a flat surface is usually unavailable or located at an otherwise inappropriate area with respect to the campsite.

Depending on the season and the particular environment, these portable stoves may be assembled and operated directly on the ground, however, ground coverings, such as loose dirt, pine needles, snow, or grass create an unstable, awkward and potentially dangerous working surface.

During alpine camping and hiking, when the temperature is typically below freezing, it is usually difficult to find an appropriate surface for the camping stove due to snow and ice on the ground. Neither snow nor ice provides a suitable supporting surface for a stove because heat radiated from the stove will melt the frozen supporting surface and invariably create an unstable (and wet) operating surface.

The camping stove is often operated within a tent. Although this provides ambient heat and a dry clean sheltered cooking area, the floor of a tent is usually uneven and the tent material and the sleeping bags within the tent are made from a highly flammable material. Such potential hazards should outweigh the benefits, however, at times there is little alternative. Campers generally must use whatever available resources they have to create a flat, insulative mounting arrangement to which a stove may be secured so that a tent floor is protected during cooking. Moreover, due to the dangers associated with having an open flame in a tent, it is desirable provide a stove that can be quickly removed from the tent if necessary.

Another difficulty associated with using portable stoves during the winter is that the fuel bottle often becomes frozen to the ground when it comes into contact with the surrounding snow or ice.

One attempt to overcome the shortcomings of the prior art is shown in U.S. Pat. No. 5,323,757 which describes a portable mounting apparatus for mounting a stove to a filleting board. The board is subsequently secured to a fixture on a motor vehicle or boat that is immediately accessible. Although this device may provide a safe flat working surface, the device relies on the structural support provided by a boat or a land vehicle. Accordingly, this device is not very practical in many camping situations where no such vehicle is available.

Thus, there is a need for a convenient apparatus that secures a portable camping stove and fuel bottle to a flat, level base structure, which is lightweight and easily transportable in a backpack. There is a further need for an apparatus that securely fastens the stove and fuel bottle to a rigid base structure that permits the rapid removal of the connected stove assemblage in the event of an emergency. There is further need of a mounting apparatus that functions as an insulating barrier that protects the supporting surface from the heat generated and radiated by the stove.

It is an object of the invention to provide a support for use with a portable stove that overcomes the deficiencies of the prior art.

It is another object of the invention to provide a safe and practical support for use with a portable stove;

It is a further object of the invention to provide a support to which a portable stove may be removably secured including a fuel supply, that may be easily assembled while wearing gloves or mittens.

It is a further object of this invention to provide a support that prevents the fuel bottle from coming into direct contact with snow or ice.

It is yet another object of the invention to provide a support to which a portable stove may be removably secured including means to prevent heat generated by the stove from reaching the support.

SUMMARY OF THE INVENTION

A supporting device used to securely mount a selectively removable portable stove and a fuel tank to a planar supporting structure without the use of hand tools. The supporting device includes a flat rigid base to which is attached a strap fastener for securing the fuel tank, and one of several mounting assemblies, each of which being adapted to secure to the base one of several different types of stoves. Thermal insulation is located between the mounting assembly and the base so that heat generated from the stove does not reach either the base or the surrounding area. In a preferred embodiment of this invention, the mounting assemblies include a strap with hook and loop fasteners, which are attached to the base. The strap is preferably made of a heat resistant material.

DETAILED DESCRIPTION OF THE PREFERRED EMBODIMENTS

Figure 1:
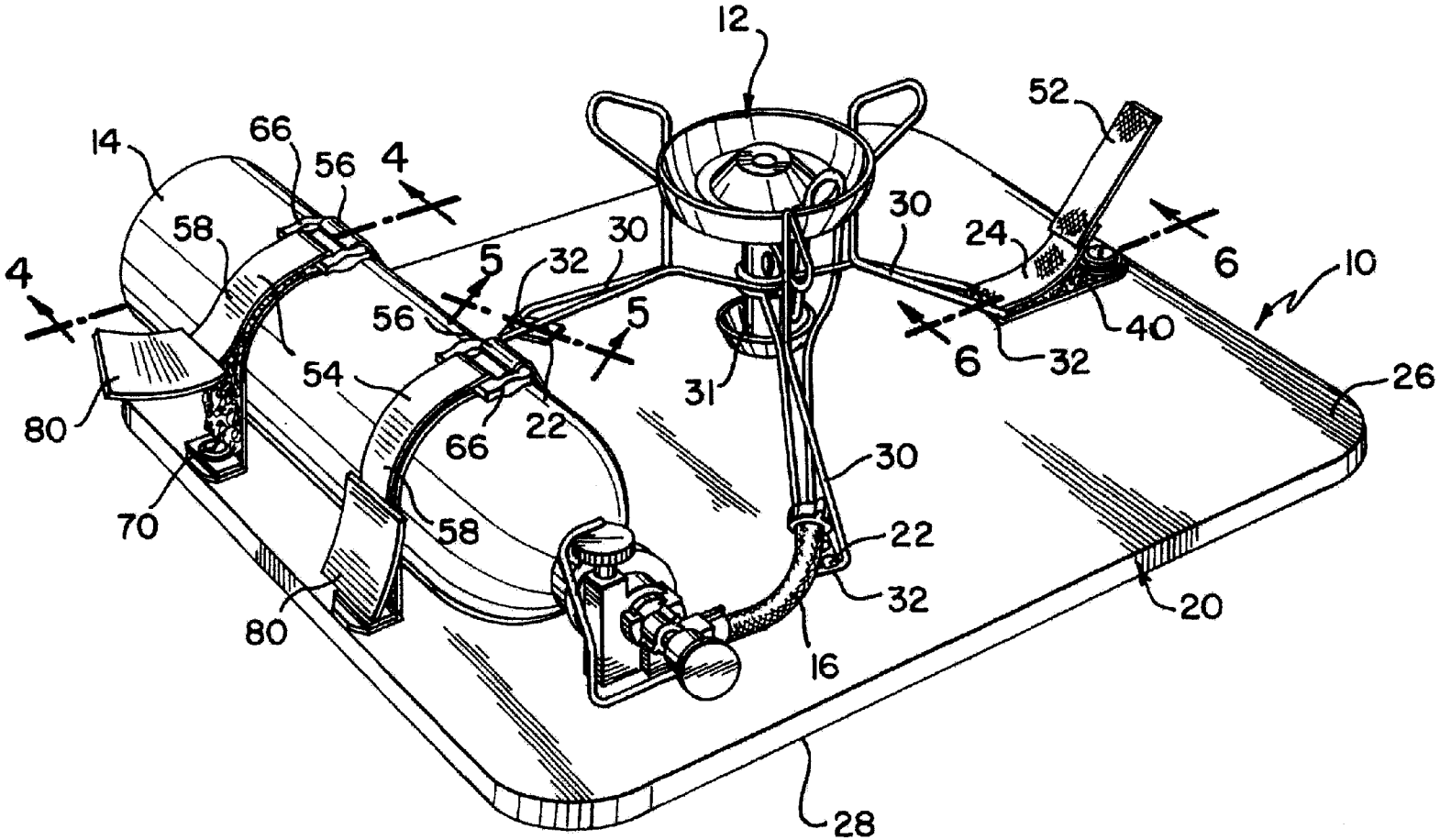
FIG. 1 is a perspective view of a stove and fuel supply secured to a support base in accordance with a first embodiment of the invention.

Referring to FIG. 1, a support assembly 10, according to a first embodiment of the invention, is shown supporting a first type of a conventional stove 12, a fuel tank 14 and a fuel line 16. Support assembly 10 includes a base 20, two locking clips 22, and a stove-securing strap 24. Base 20 has an upper surface 26 and a lower surface 28. Support assembly 10, according to this particular embodiment, is adapted to secure a type of commercially available camping stove 12 which includes three supporting legs 30 that are made from wire and are downwardly disposed trigonally (like a tripod) so that a nozzle assembly 31 of stove 12 is suspended above a working surface, such as base 20. Supporting legs 30 of stove 12 are equally spaced approximately 120 arc degrees from each other and contact upper surface 26 of base 20 at three contact points 32. Base 20 is preferably made from a strong, rigid, lightweight, heat-insulative material, such as treated wood, fiberglass, plastic, or other suitable material that is sufficiently strong and rigid to support a heavy cooking pot (or preferably at least 10 lbs.). Base 20 may be made from a fire/heat-resistant material or may include the same as a coating or layer. Such materials are known by those skilled in the art.

Figure 5:
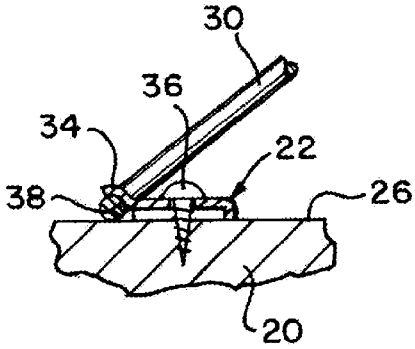
FIG. 5 is a sectional view taken along line 5—5 of FIG. 1, showing a stove leg secured to the support base, according to the first embodiment of the invention.

Each of the two locking clips 22, as shown in FIGS. 1 and 5, includes a projecting flange 34 and are secured to base 20 at two of the three contact points 32, using any suitable fastener such as a screw 36. Each locking clip 22, when secured to base 20, defines a locking space 38, located between upper surface 26 and projecting flange 34. Locking space 38 of each of the two locking clips 22 is sized and shaped to snugly receive and hold each of two legs 30 of stove 12, respectively.

Figure 6:
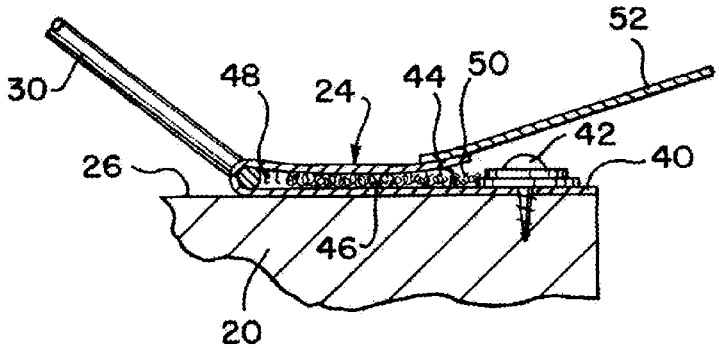
FIG. 6 is a sectional view taken along line 6—6 of FIG. 1, showing another stove leg secured to the support base, according to the first embodiment of the invention.

Stove-securing strap 24 is preferably made from a tough flexible material, such as flat woven nylon and includes a loop/hook type fastener (such as Velcro, trademark). Stove-securing strap 24 includes a fixed end 40 which is attached to base 20 with any suitable fastener, such as a screw 42, and a free end 44. As shown in FIGS. 1 and 6, stove-securing strap 24 includes a loop portion 46 of the loop/hook fastener, located on a surface 48 of strap 24, adjacent to fixed end 40. Stove-securing strap 24 also includes a hook portion 50 of loop/hook fastener, located on surface 48, adjacent to free end 44. Free end 44 preferably includes an extension 52 which functions as a grasping handle for strap 24. Free end 44 is preferably sufficiently long and large so that an operator wearing bulking hand coverings, such as gloves, mittens, or a pot holder.

In operation of stove-securing strap 24, stove 12 is positioned on base 20 so that two clip-secured legs 30 lodge within locking space 38 of respective locking clips 22. The remaining strap-secured leg 30 of stove 12 will automatically align with stove-securing strap 24 so that stove-securing strap 24 may be looped through strap-secured leg 30 and folded back onto itself in such a manner that engages hook portion 50 with loop portion 46, as is generally understood by those skilled in the art. Stove-securing strap 24 may be drawn tightly prior to engaging the loop/hook fastener so that clip-secured legs 30 that are located within respective locking spaces 38 of locking clips 22 are forced into tight locking engagement with locking clips 22. With this arrangement, stove-securing strap 24 directly secures strap-secured leg 30 of stove 12 to base 20, and indirectly secures the other two clip-secured legs 30 to base 20 (through engagement with locking clips 22).

Loop/hook fastener may be released by lifting extension 52. Once released, strap-secured leg 30 may be separated from base 20, and clip-secured legs 30 may be disengaged from locking space 38.

Accordingly, stove 12 may be quickly and effectively secured to and removed from base 20.

Figure 4:
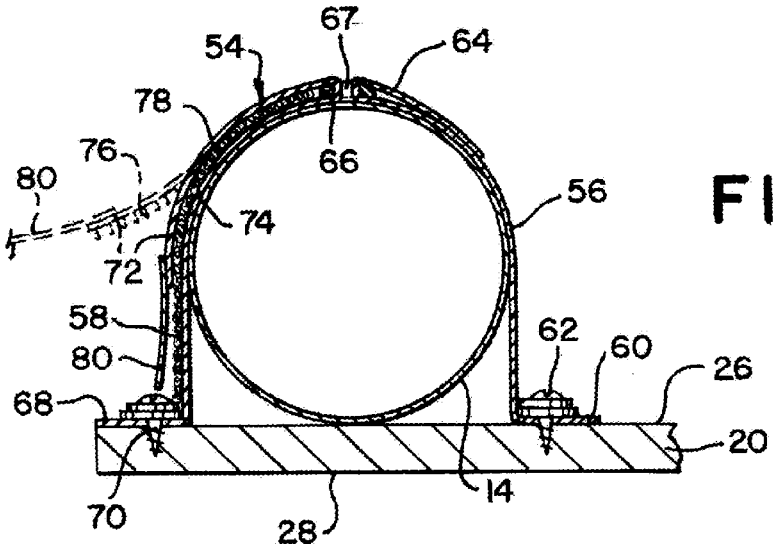
FIG. 4 is a sectional view taken along line 4—4 of FIG. 1, showing a tank secured to the support base using a fastening system in accordance with the invention.

Referring to FIGS. 1 and 4, two tank-securing straps 54 are used to tightly fasten fuel tank 16 to base 20 in a selectively removable manner, as described below. Both tank securing straps 54 are identical in structure and function and therefore, only a single tank-securing strap 54 will be described in detail here.

Tank-securing strap 54 includes an anchor portion 56 and a securing portion 58. Anchor portion 56 has a fixed end 60 which is attached to base 20 using any appropriate fastener, such as a screw 62, and a free end 64. A buckle 66 is attached to free end 64 of anchor portion 56. Buckle 66 includes an opening 67 that is sized and shaped to receive at least a portion of securing portion 58 of tank-securing strap 54.

Securing portion 58 includes a fixed end 68 which, like anchor portion 56, is attached to base 20 using any appropriate fastener, such as screw 70, and a free end 72. Similar to the above described stove-securing strap 24, securing portion 58 of tank-securing strap 54 preferably includes a loop/hook-type fastener having a loop portion 74 and a hook portion 76. Again, loop portion 74 is preferably located on a surface 78 of strap 54 and adjacent to fixed end 68. Hook portion 76 is preferably located on surface 78, adjacent to free end 72. Free end 72 preferably includes an extension 80, similar to stove-securing strap 24, described above.

In operation of tank-securing strap 54, tank 14 is positioned onto base 20, as shown in FIG. 1, adjacent to both tank-securing straps 54 (one or more straps may be used to secure tank 14 to base 20 without departing from the gist of this invention). Once tank 14 is positioned between anchor portion 56 and securing portion 58, free end 72 of securing portion 58 is looped through opening 67 of buckle 66 and drawn tightly back upon itself so that loop portion 74 engages with hook portion 76. This action pulls tank 14 into tight engagement with base 20.

Although tightly secured to base 20, tank 14 may be quickly and easily released by lifting extension 80 so that loop portion 74 separates from hook portion 76 allowing at least a portion of securing portion 58 to be loosened through buckle 66, with respect to anchor portion 56. Once loosened, tank 14 may be slid longitudinally from engagement between securing portion 58 and anchor portion 56 and removed from base 20. In this loosened position, free end 72 and extension 80 preferably remain looped through opening 67 of buckle 66.

Fuel line 16 is preferably not separately secured to base 20. Since fuel line 16 is secured to both tank 14 and stove 12, Applicant has determined that further securement to base 20 is not necessary. With the particular type of commercially available stove 12 shown in FIG. 1, fuel line 16 is,usually passed through one leg 30, which indirectly secures fuel line to base 20.

Figure 2:
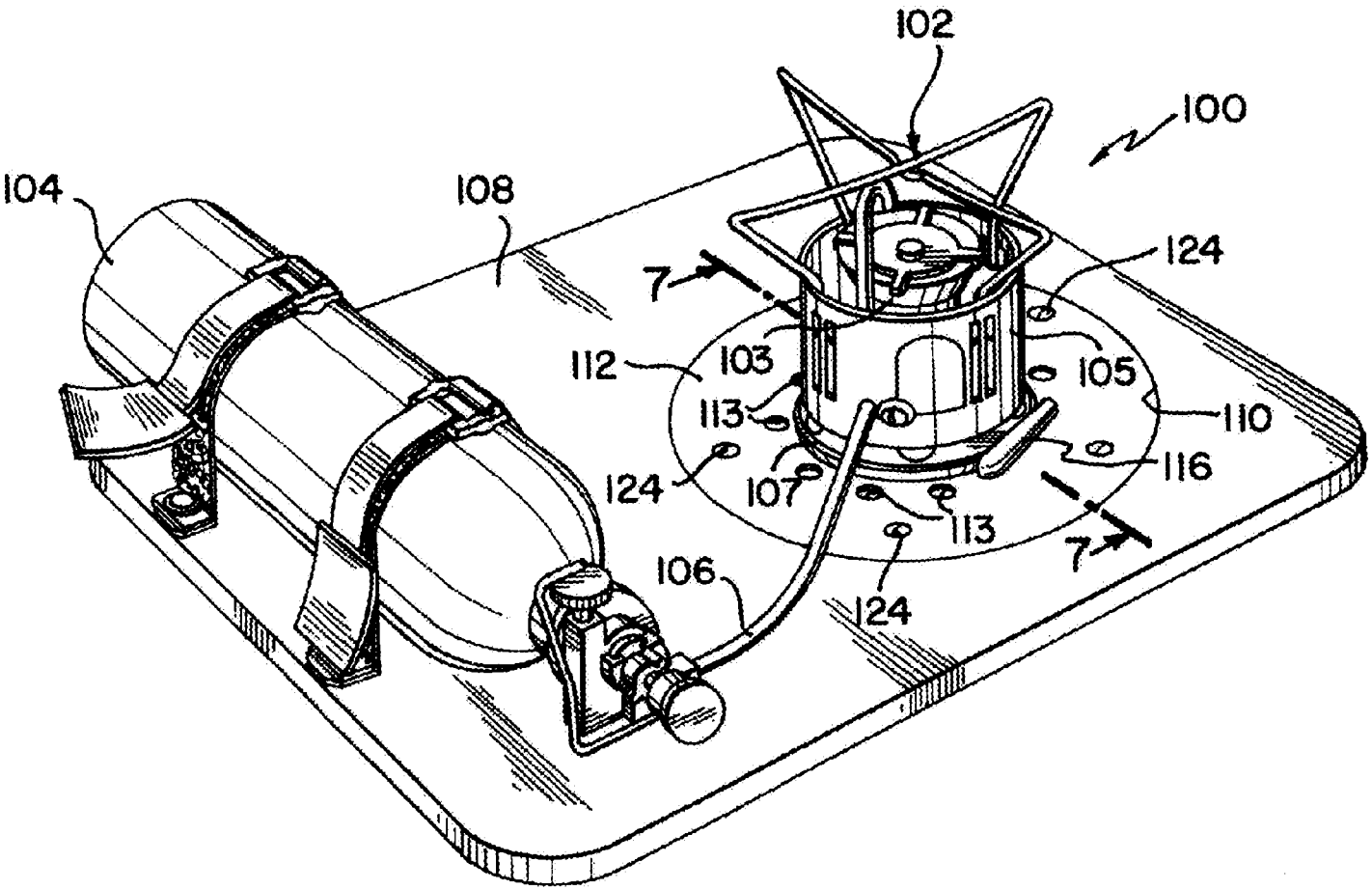
FIG. 2 is a perspective view of a stove and fuel supply secured to a support base in accordance with a second embodiment of the invention.
Figure 7:
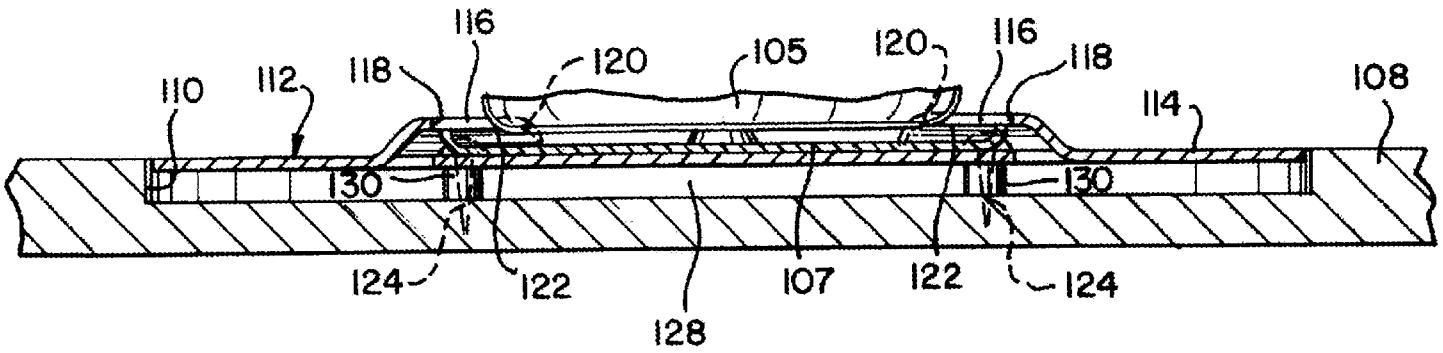
FIG. 7 is a sectional view taken along line 7—7 of FIG. 2, showing details of a securing system used to secure the stove to the support base, according to the second embodiment of the invention.

Referring to FIGS. 2 and 7, a support assembly 100 according to a second embodiment of the invention is shown supporting a second type of commercially available stove 102, a tank 104 and a fuel line 106. An example of stove 102 is XGK. II, made by Montana Safety Research of Seattle, Wash. Stove 102 includes a nozzle 103 and a body 105 having base plate 107. According to this embodiment of the invention, support assembly 100 includes a generally flat base 108 having a recess 110, and a generally circular securing plate 112, having a center and several openings 113. Securing plate 112 includes an upper surface 114 and two opposing, elongated, upwardly directed projections 116, each of which being positioned along a respective projection axis and each being located on opposing sides of the center of securing plate 112. Each elongated projection 116 is angled with respect to each other, thereby defining an outward end 118 and an inward end 120 wherein an outermost distance measured between respective outward ends 118 of each projection 116 is greater than an innermost distance measured between respective inward ends 120 of each projection 116. Each projection axis being generally parallel to upper surface 114 and directed towards each other at a predetermined angle.

Each projection 116 includes an inwardly directed (towards the center of securing plate 112) flange 122 that is generally parallel to upper surface 114. Both inwardly directed flanges 122 being located within a common plane that is generally parallel to upper surface 114 and is displaced above upper surface 114 a predetermined distance (approximately ¼" to about ½"). The purpose of inwardly directed flanges 122 is to lock onto base plate 107 and thereby selectively secure stove 102 to base 108. Flanges 122 are located above securing plate 112 and above base plate 107. Base plate 107 is preferably circular and has a diameter that is between outermost distance and innermost distance so that base plate 107 may be inserted between opposing projections 116 and held to base 108.

Recess 110 is sized and shaped to receive securing plate 112 so that upper surface 114 of securing plate 112 is generally flush with base 108. Securing plate 112 is preferably secured to base 108 (within recess 110) using any appropriate fastener, such as screws 124 which pass through openings 113. According to the invention securing plate 112 is mounted within recess 110 so that an air gap or space 128 is formed between securing plate 112 and the bottom of recess 110 (which is base 108). To establish space 128, it is preferred that teflon spacers 130 are positioned between securing plate 112 and base 108 (the bottom of recess 110), preferably around each fastener 124, as shown in FIG. 7. As discussed above, space 128 functions as a heat insulator preventing any heat radiated or otherwise generated by stove 102 from reaching base 108 (or the supporting surface on which the support assembly 100 rests).

Tank 104, as shown in FIG. 2, is secured to base 108 using the same securing assembly as in the above described embodiment, as shown in FIG. 1, and is therefore not further described here.

In operation of support assembly 100, shown in FIGS. 2 and 7, base plate 107 of stove 102 is positioned between outer ends 118 of projections 116 and slid along upper surface 114 of securing plate 112 across the center of securing plate 112 so that base plate 107 moves under and frictionally engages with flanges 122, as shown in FIG. 7. Once stove 102 is secured to base 108 by projections 116, fuel line 106 may be connected to stove 102 and tank 104 (if it is not already connected), and tank 104 may be secured to base 108 using securing straps in a manner that is similar to the method tank 14 is secured to base 20 in the above described embodiment (see FIG. 1). According to this embodiment, once tank 104 is secured to base 108, tank 104 and fuel line 106 prevents stove 102 from disengaging from projections 116.

To remove stove 102 from base 108, tank 104 is first loosened or removed and thereafter, stove 102 is moved towards tank 104 so that base plate 107 of stove 102 disengages from flange s 122 of projections 116.

Figure 3:
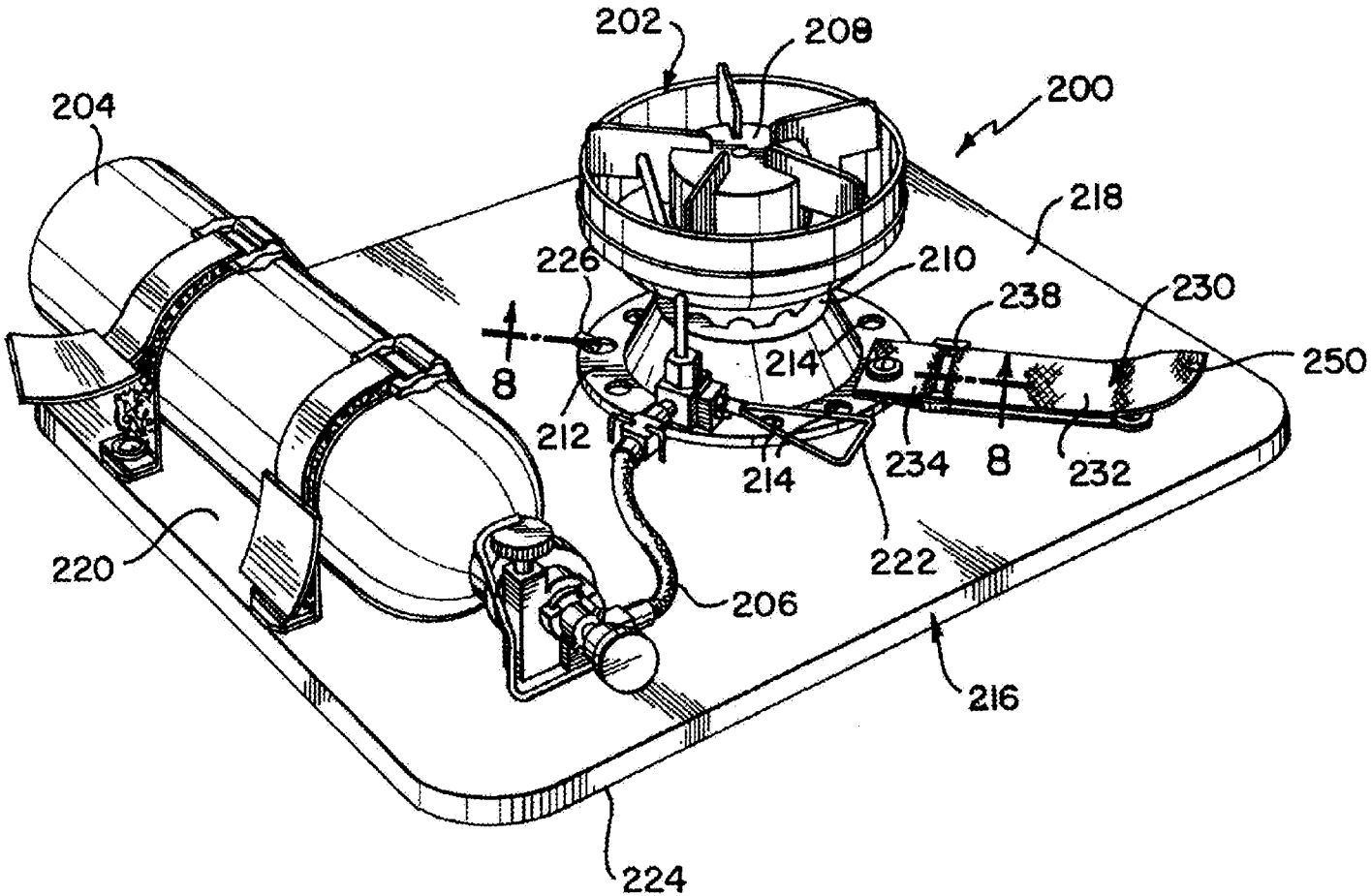
FIG. 3 is a perspective view of a stove and fuel supply secured to a support base in accordance with a third embodiment of the invention.
Figure 8:
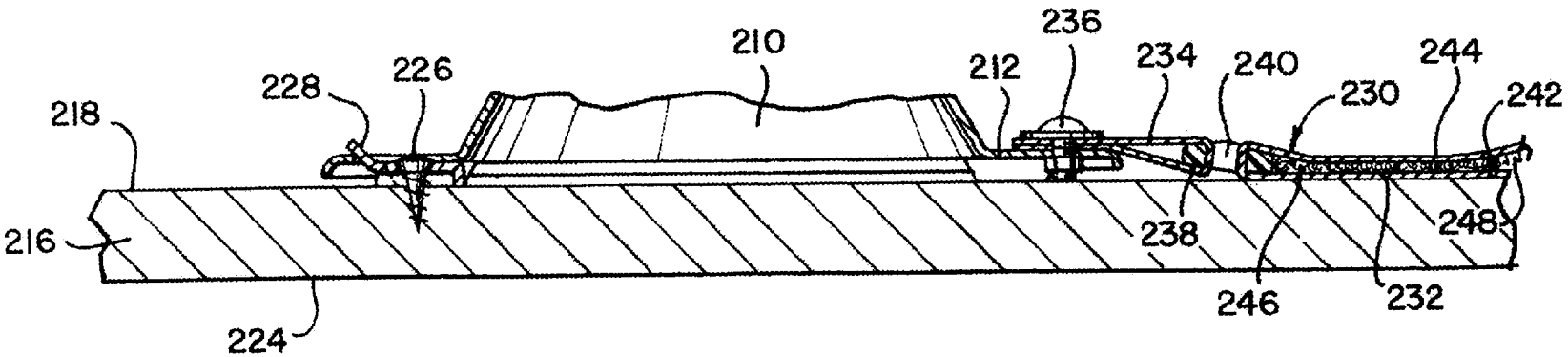
FIG. 8 is a sectional view taken along line 8—8 of FIG. 3, showing details of a securing system used to selectively secure the stove to the support base, according to the third embodiment of the invention.

Referring to FIGS. 3 and 8, a support assembly 200, according to another embodiment of the invention, is shown supporting a third type of commercially available stove 202, a tank 204, and a fuel line 206. An example of stove 202 is PEAK-1 APEX II, made by The Coleman Company, Inc., of Wichita, Kans. Stove 202 includes a nozzle 208 and a body 210 having an integrally formed flat and circular base plate 212. Base plate 212 includes a plurality of openings 214 located along its periphery, as shown in FIG. 3.

A rigid flat base 216, similar to the above described two embodiments, includes an upper surface 218 having a tank receiving region 220 and a stove receiving region 222, and a lower surface 224. An anchor 226 is attached to upper surface 218 of base 216 and includes a hook portion 228 which projects generally upwardly from upper surface 218, preferably in a slightly curved manner to define a hook. Anchor 226 is preferably located adjacent to stove-receiving region 222 and hook portion 228 is preferably sized and shaped to fit within at least one of the plurality of openings 214 located within base plate 212 of stove 202.

Also located adjacent to stove-receiving region 222 and generally opposite anchor 226 is a stove-securing strap assembly 230, which includes an anchor strap 232 and a securing strap 234. Anchor strap 232 is a strap of strong flexible material that is secured to one opening 214 of base plate 212 of stove 202 using a bolt 236, for example. Anchor strap 232 includes a buckle 238 which defines an opening 240. Opening 240 is sized and shaped to selectively receive a portion of securing strap 234. Securing strap 234 includes a fixed end 242 which is attached to upper surface 218 of base 216, and a free end 244. A loop portion 246 of a conventional loop/hook-type fastener (e.g., Velcro (trademark)) is attached to one surface of securing strap 234, adjacent to fixed end 242. A hook portion 248 of the loop/hook fastener is attached to the same surface of securing strap 234, adjacent to free end 244. An extension 250 (see FIG. 3) is preferably provided at free end 244 to aid in releasing securing strap 234 from stove 202, as described below.

In operation of this embodiment, stove 202 is positioned within the stove-receiving region 222 so that hook portion 228 engages with one opening 214 of base plate 212. Once the stove is "engaged" with hook portion 228, free end 244 of securing strap 234 is inserted into opening 240 of buckle 238 of anchor strap 232 and drawn tightly generally away from anchor 226 so that stove 202 tightly engages between hook portion 228 and anchor strap 232 and is thereby secured to upper surface 218 of base 216.

Tank 204 is secured to base 216 using the same fastening system used in the earlier embodiments, described above, and is therefore not described in greater detail here.

Figure 9:
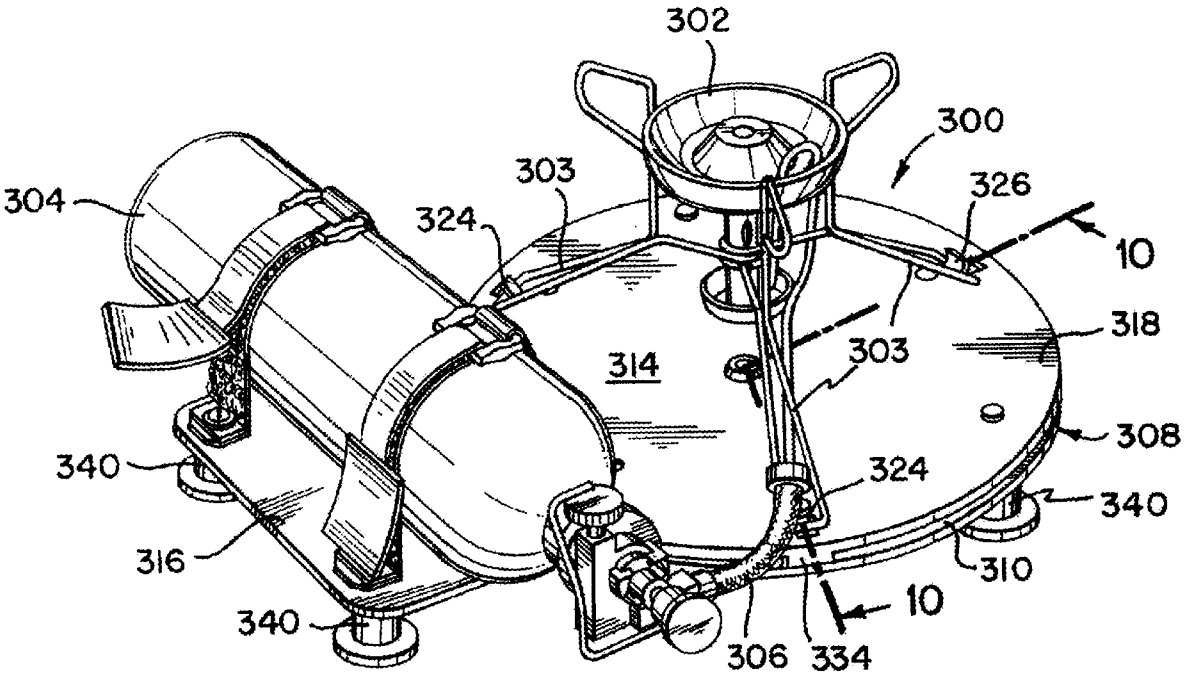
FIG. 9 is a perspective view of a stove and fuel tank assembly secured to a support base, according to a fourth embodiment of the invention.
Figure 10:
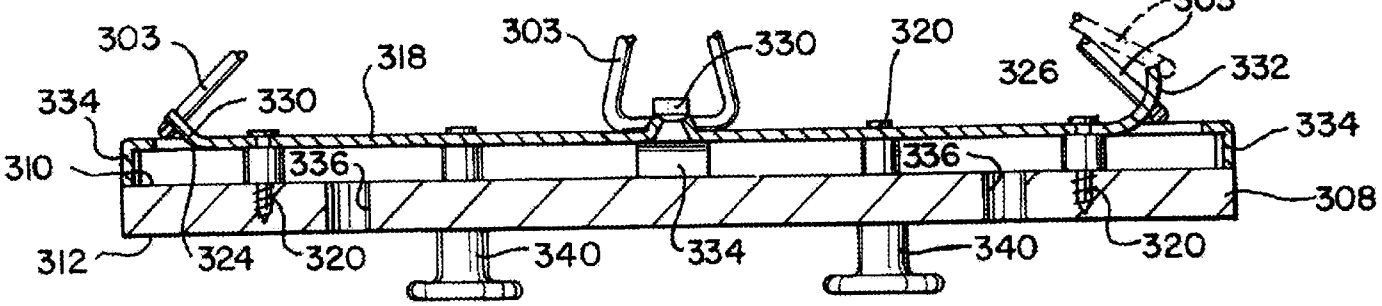
FIG. 10 is a sectional view taken along the line 10—10 of FIG. 9, showing details of a securing system according to the fourth embodiment of the invention.

Referring to FIGS. 9 and 10, a support assembly 300 is shown, according to another embodiment of the invention, supporting a stove 302 which is similar to the one discussed above and shown in FIG. 1, including three downwardly directed, radially extending wire legs 303. Also supported is a fuel tank 304, and a fuel line 306. A base 308 includes an upper surface 310, a lower surface 312, a stove-receiving region 314, and a tank-receiving region 316.

Tank 304 is selectively secured to base 308 within tank-receiving region 316 using a fastening system that is identical in structure and function to the tank fastening system disclosed in each of the above-described embodiments.

A stove-mounting plate 318 is secures with fasteners (such as screws 320) to upper surface 310 in stove-receiving region 314 of base 308.

Stove-mounting plate 318 is preferably circular and made from a heat-resistant material which is both conductive and reflective, such as steel or aluminum. The purpose of stove-mounting plate 318 is provide heat-insulative between a mounted stove 302 and upper surface 310 by introducing an air space between stove-mounting plate 318 and base 308.

Stove-mounting plate 318 includes three radially extending feet, two of which are locking feet 324 and a third is a securing foot 326. All three feet 324, 326 include a downwardly directed contact portion 328 that contacts the upper surface of the stove mounting plate 318 located above base 308. Locking feet 324 include an outermost upperwardly directed portion 330 which is sized and shaped to snugly receive and lockingly engage with a portion of two respective stove legs 303. Securing foot 326 includes an upwardly directed, rounded portion 332 which is sized and shaped to selectively receive a portion of a third stove leg 303 in a releasably engagable manner.

Stove-mounting plate 318 may include additional downwardly directed supporting feet 334 to provide additional support. Base 308 includes openings 336 at stove-receiving region 314 which help vent-off any heat that accumulates between stove-mounting plate 318 and upper surface 310 of base 308 and prevents heat generated by stove 302 from reaching base 308.

In operation, stove 302 is positioned within stove-receiving region 314 of base 308 so that two of its three legs 303 align and engage with locking feet 324. Once stove 302 is loosely engaged with locking feet 324, the remaining securing foot 326 may be drawn over rounded portion 332 until it becomes engaged with securing foot 326. The elastic nature of stove legs 303 and securing foot 326 allow stove legs 303 to be selectively secured to stove-mounting plate 318.

In each of the above-described embodiments of the invention, supporting legs 340 may be attached to the lower surface of base 308, as shown in FIG. 9, to support and protect base 308 over a working surface.

Having described the presently preferred exemplary embodiment of a new and improved portable cooking apparatus, in accordance with the present invention, it is believed that other modification, variations and changes will be suggested to those skilled in the art in view of the teachings set forth herein. It is, therefore, to be understood that all such modifications, variations and changes are believed to fall within the scope of the present invention as defined by the appended claims.

What is claimed is:

1. A mounting apparatus for supporting a portable stove, comprising:

a base;

a mounting plate attached to said base, said mounting plate having an upper surface and being located in a plane that lies a predetermined distance above said base, defining an intermediate space; and securing tabs attached to said mounting plate, said tabs being adapted to selectively grip a portion of said stove so that said stove may be selectively secured to said mounting plate, said predetermined distance above base;

wherein said mounting plate and intermediate space insulates and protects said base from heat radiating from said stove.

2. The invention of claim 1, further comprising means for securing a fuel tank, used to supply said stove with fuel, to said base.

3. The invention of claim 2, wherein said securing means includes securing straps.

4. The invention of claim 3 wherein said securing straps further comprise a grasping tab of sufficient size to be operated by an operator wearing gloves or mittens.

5. The invention of claim 3, wherein said straps are made of heat resistant material.

6. The invention of claim 3, wherein said securing straps include and anchor portion and a securing portion, a buckle is attached to said anchor portion, said securing portion is looped through an opening in said buckle.

7. The invention of claim 6, wherein said securing portion includes a fastener that is selecteviely connected to secure said fuel tank to said based and selectively separated to remove said fuel tank from said base.

8. The invention of claim 7, wherein at least a portion of said securing portion remains looped through said opening in said buckle when said fastener is connected and seprated.

9. The invention of claim 1, wherein said base is made from a fire resistant material.

10. The invention of claim 1 wherein said mounting plate is made of metal.

11. The invention of claim 1 wherein said securing tabs have no moving parts.

12. The invention of claim 11 wherein said securing tabs are formed out of the same piece of material as said mounting plate.

13. A mounting apparatus for supporting a portable cooking apparatus, comprising:

a substantially flat base having a surface area in relation to the weight of said apparatus effective in supporting said apparatus upon soft surface such as snow;

said base having first securing device for detachably securing a cooking element directly to said base; and said base having a second securing device spaced from said securing device for detachably securing a fuel supply directly to said base.

14. The invention of claim 13 wherein said base further comprises a securing plate to which said first securing device is attached; and said securing plate comprises a fire-resistant material.

15. A portable cooking apparatus according to claim 13, further comprising a fuel conduit being in fluid communication with said fuel supply and said cooking element.

16. A portable cooking apparatus according to claim 13, wherein each of said first and second securing devices include at least one grasping tab for gripping and removal of at least one of said cooking element and said fuel supply.

17. A portable cooking apparatus according to claim 13, wherein said first securing device includes at least one locking clip and loop that is attached to said base.

18. A portable cooking apparatus according to claim 13, wherein said base is coated with a fire resistant material.

19. A portable cooking apparatus according to claim 13, wherein said base is made of a fire resistant material.

20. A portable cooking apparatus, comprising:

a cooking element;

a substantially flat base made of a heat-insulative material and coated with a fire-resistant material;

a first securing device for detachably securing said cooking element directly to said base; and a second securing device for detachably securing a fuel supply to said base.

21. The invention of claim 20 wherein said base further comprises a securing plate to which said first securing device is attached; and said securing plate comprises a fire-resistant material.

22. The portable apparatus of claim 20, wherein said first securing device comprises at least one locking clip and a strap.

23. The portable cooking apparatus of claim 22, wherein said second securing device includes at least one strap.

24. The portable cooking apparatus of claim 20, wherein said first securing device includes a pair of inwardly directed flanges.

25. The portable cooking apparatus of claim 24, wherein said flanges are spaced approximately 120° apart.

26. The portable cooking apparatus, comprising:

a cooking element;

a substantially flat base made from a fire resistant material and having sufficient surface area in relation to the weight of said apparatus effective in supporting said apparatus upon a soft surface;

a first securing device for detachably securing said cooking element directly to said base; and a second securing device spaced from said first securing device for detachably securing a fuel supply to said base.

27. The invention of claim 26 wherein said base further comprises a securing plate to which said first securing device is attached; and said securing plate comprises a fire-resistant material.

* * * * *